US005631072A

United States Patent [19]

Samson et al.

[11] Patent Number: 5,631,072

[45] Date of Patent: May 20, 1997

[54] METHOD AND MEANS FOR INCREASING EFFICACY AND WASH DURABILITY OF INSECTICIDE TREATED FABRIC

[75] Inventors: Richard D. Samson; James M. McKinney; Geoffrey Gettliffe, all of North Augusta; John Russell, Aiken, all of S.C.

[73] Assignee: Avondale Incorporated, Sylacauga, Ala.

[21] Appl. No.: 595,795

[22] Filed: Feb. 2, 1996

Related U.S. Application Data

[63] Continuation-in-part of Ser. No. 401,986, Mar. 10, 1995, Pat. No. 5,503,918.

[51] Int. Cl.[6] ..... A01N 25/34; B32B 33/00; E04H 15/54

[52] U.S. Cl. ..... 442/125; 135/115; 424/403; 428/907

[58] Field of Search ..... 428/248, 252, 428/264, 265, 907; 135/115; 424/403

[56] References Cited

U.S. PATENT DOCUMENTS

| | | |
|---|---|---|
| 3,859,121 | 1/1975 | Yeadon et al. . |
| 3,995,034 | 11/1976 | Strobel . |
| 4,594,286 | 6/1986 | McKinney et al. . |
| 4,765,982 | 8/1988 | Ronning et al. . |
| 4,833,006 | 5/1989 | McKinney et al. . |
| 5,089,298 | 2/1992 | McNally et al. . |
| 5,198,287 | 3/1993 | Samson et al. . |
| 5,252,387 | 10/1993 | Samson et al. . |
| 5,503,918 | 4/1996 | Samson et al. . |

*Primary Examiner*—James C. Cannon

*Attorney, Agent, or Firm*—Clifton Ted Hunt

[57] ABSTRACT

This invention relates to the manufacture of fabric intended to be made into washable garments, and more specifically to the placement of an insecticide such as permethrin in the fabric by impregnation with polymeric binders and a cross-linking agent; or by surface coating with a polymeric binder and a thickening agent to improve the efficacy as an insect repellent and retention of the permethrin in the fabric as an effective insecticide through successive washings of the garments.

19 Claims, 3 Drawing Sheets

METHOD AND MEANS FOR INCREASING EFFICACY AND WASH DURABILITY OF INSECTICIDE TREATED FABRIC

CROSS REFERENCE TO RELATED APPLICATION

This application is a continuation-in-part of application Ser. No. 08/401,986 filed Mar. 10, 1995 by Samson et al. for METHOD AND MEANS FOR RETAINING PERMETHRIN IN WASHABLE FABRICS and now U.S. Pat. No. 5,503,918.

FIELD OF THE INVENTION

This invention relates to the finishing of washable fabric intended to be made into wearing apparel and more specifically to the finishing of such fabric with an insecticide, such as permethrin, by a process that increases the knock-down efficacy and the retention of the insecticide in the fabric through successive washings.

BACKGROUND OF THE INVENTION

Permethrin is a synthetic pyrethroid which exhibits repellent as well as knockdown and kill activity against insects. Pyrethroids, including both the naturally occurring compounds and their synthetically prepared analogs effectively control a variety of pests, such as ticks, cockroaches, houseflies, mosquitoes, black flies, fleas, and other flying or crawling insects. Pyrethroids are not harmful to plants, food, animals or humans, and leave no harmful residues.

Despite these highly favorable characteristics, permethrin has had only limited general utility because of its relatively short-lived insecticidal activity. This is due to the decomposition of permethrin into a nonactive, non-insecticidal product in the presence of oxygen and ultraviolet light.

U.S. Pat. No. 5,198,287 issued Mar. 30, 1993 to Samson, et al. for INSECT REPELLENT TENT FABRIC discloses a tent fabric with a water repellent and flame retardant coating that includes the insecticide permethrin. The patent teaches that placing the permethrin in the coating on the inner surface of the tent enables the tent fabric and outer surface coating to shield the permethrin from oxygen and ultraviolet light and thereby provide an effective life of more than six months for the permethrin.

U.S. Pat. No. 5,252,387 issued Oct. 12, 1993 to Samson for FABRICS WITH AN INSECT REPELLENT AND A BARRIER teaches that permethrin can be preserved in insect repellent fabrics by placing a barrier over the permethrin to protect the permethrin from degradation by ultraviolet light and oxygen.

Another problem with using permethrin as an insect repellent in washable clothing is retaining the permethrin in washable garments through successive wash cycles.

U.S. Pat. No. 5,089,298 issued Feb. 18, 1992 to McNally for SYNERGISTIC EFFECT OF AMYLOPECTIN-PERMETHRIN IN COMBINATION ON TEXTILE FABRICS offers one solution to the problem of retaining permethrin in clothing through successive wash cycles. McNally teaches that permethrin is retained in garments impregnated with permethrin and amylopectin, a water soluble form of starch, through a substantially greater number of laundering cycles than garments treated only with permethrin.

Applicants' parent application, Ser. No. 08/401,986, teaches that an initial concentration in a fabric of approximately 1.25 grams of permethrin per square meter is strong enough to repel insects. The '986 application also teaches that the addition of polyvinyl acetate as a binder for the permethrin dispersion preserves the effectiveness of the permethrin through more washings of the fabric than does McNally's amylopectin.

Applicants' research has continued for effective use of permethrin in repelling mosquitoes and other insects, and applicants have found polymeric binders other than the polyvinyl acetate disclosed in our parent '986 application to be effective in prolonging the durability of permethrin. Applicants have also found a process of applying permethrin to the fabric that effectively increases the repellency of insects and that maintains the effectiveness of permethrin after repeated launderings of the treated fabric.

SUMMARY OF THE INVENTION

The parent application, Ser. No. 08/401,986, teaches the addition of polyvinyl acetate to the permethrin by first impregnating the fabric with polyvinyl acetate and then impregnating the fabric in a second tank with a permethrin dispersion that provides an initial concentration in a fabric of approximately 1.25 grams of permethrin per square meter, which is more than enough to repel insects.

Applicants have now learned that a dispersion of permethrin and an effective polymeric binder can be effectively applied to the fabric by impregnation in a single tank.

Applicants have also discovered that permethrin can be effectively applied to the fabric in a surface coating on only one side of the fabric. There are, then, two embodiments of the present invention: (1) Impregnating the fabric with permethrin, and (2) Surface coating only one side of the fabric with permethrin.

In the first embodiment, fabric that is to be made into washable garments is dyed and finished in the normal manner and then impregnated with a suitable polymeric binder and with a dispersion of permethrin, and sometimes a cross-linking agent. In the second embodiment, only one side of any desired fabric is surface coated with an insecticide and a thickener, and sometimes a suitable polymeric binder with or without a cross-linking agent.

DETAILED DESCRIPTION OF THE INVENTION

The fabric or substrate with which this invention is used may be of any desired type. For example, the fabric may be a plain weave polyester fabric or a 65/35 blend of polyester and cotton suitable for the manufacture of clothing. Alternatively, but not exclusively, the fabric may be intended for a military battle dress uniform made of either 100% rip-stop cotton or 50% nylon and 50% cotton.

A permethrin dispersion that provides approximately 1.25 grams of permethrin per square meter in a selected fabric was used to find the effectiveness of polymeric binders; and cross-linking agents as synergists to prolong the retention of permethrin in washable fabrics.

The exact amount of permethrin to be added depends on the type of fabric being treated. Different fabrics absorb or assimilate different amounts of the permethrin dispersion. The exact amount of permethrin is determined by successive trials to find the amount necessary to provide an initial concentration in the selected fabric of approximately 1.25 grams of permethrin per square meter. That initial concentration has been found to provide effective insecticide properties and/or insect contact repellency.

The First Embodiment—Impregnation

Figure 1:
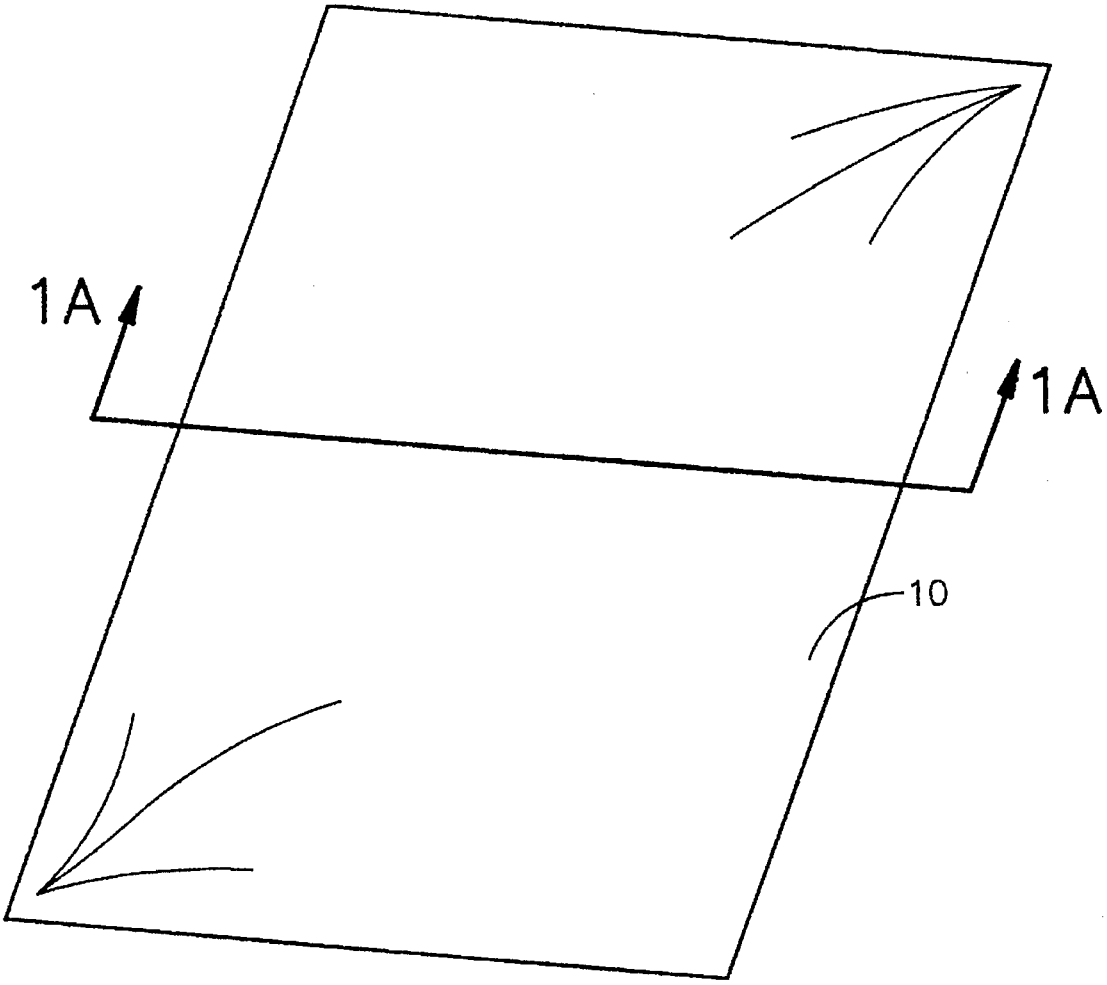
FIG. 1 is a perspective view of fabric that has been treated with permethrin by impregnating the fabric with a dispersion of permethrin and a polymeric binder.
Figure 1A:
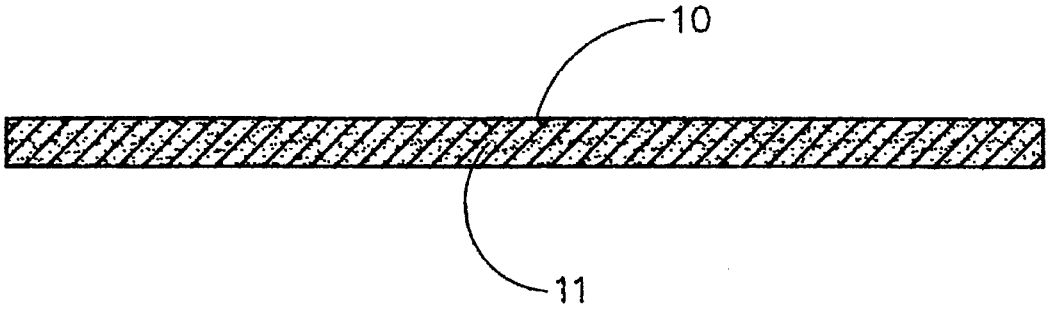
FIG. 1A is an enlarged sectional view taken substantially along the line 1A—1A in FIG. 1.

FIGS. 1 and 1A illustrate a fabric 10 that has been impregnated with a solution containing a dispersion of permethrin and a polymeric binder. The permethrin and the polymeric binder are indicated by the dots 11 in FIG. 1 A. As seen in the sectional view of FIG. 1A, the dots 11 are spread throughout the fabric 10. Permethrin is spread throughout the fabric in the same way when the permethrin is applied to fabric by impregnating the fabric in a bath containing only permethrin.

Fabrics have been impregnated with several solutions, each of which contain the same dispersion of permethrin and the same percentage of different polymeric binders and/or cross-linking agents. The treated fabrics were then subjected to home launderings and the percentage of permethrin then remaining in the fabric was measured to compare the effectiveness of the binders in retaining permethrin in the fabric.

EXAMPLES OF IMPREGNATING FABRIC WITH PERMETHRIN

Example I

Example I is a comparison of Example I-A with Example I-B to determine the retention of permethrin in fabric after one washing of the treated fabric.

Example I-A Impregnates the Fabric with Only Permethrin.

Example I-B Impregnates the Fabric with Permethrin and an Acrylic Binder.

In this first example, the fabric substrate is a 65/35 cotton/polyester blend.

In Example I-A, the fabric was impregnated with a permethrin dispersion.

In Example I-B, the fabric was impregnated with a permethrin dispersion and with a solution of ten (10) ounces of acrylic copolymer per gallon as a binder.

| Retention of Permethrin in Example I | |
|---|---|
| Example I-A | 30.8% after 5 Home Launderings; 11.9% after 10 Home Launderings. |
| Example I-B | 58.8% after 5 Home Launderings; 47.1% after 10 Home Launderings. |

Comment on Example I:

The addition of an acrylic binder improves the retention of permethrin after the fabric is washed.

Example II

Example II is a comparison of Example II-A with Example II-B to determine the retention of permethrin in fabric after five washings of the treated fabric.

Example II-A Impregnates the Fabric with Permethrin and Polyvinyl Acetate.

Example II-B Impregnates the Fabric with Permethrin and Acrylic.

In this second example, the fabric substrate is a 65/35 cotton/polyester blend.

In Example II-A, the fabric was impregnated with a permethrin dispersion and with a solution of ten (10) ounces of polyvinyl acetate per gallon as a binder.

In Example II-B, the fabric was impregnated with a permethrin dispersion and with a solution of ten (10) ounces of acrylic copolymer per gallon as a binder.

| Retention of Permethrin in Example II | |
|---|---|
| Example II-A | 37.0 percent after 5 Home Launderings. |
| Example II-B | 58.8 percent after 5 Home Launderings. |

Comment on Example II:

Use of an acrylic binder yields better laundering durability than use of a polyvinyl acetate binder.

Example III

Example III is a comparison of Example III-A with Example III-B to determine the retention of permethrin in fabric after five washings of the treated fabric.

Example III-A Impregnates the Fabric with Permethrin and Polyvinyl Acetate.

Example III-B Impregnates the Fabric with Permethrin, with Polyvinyl Acetate and with a Cross-Linking Agent.

In this third example, the fabric substrate is a 65/35 cotton/polyester blend.

In Example III-A, the fabric was impregnated with a permethrin dispersion and with a solution of ten (10) ounces of polyvinyl acetate per gallon as a binder.

In Example III-B, the fabric was impregnated with a permethrin dispersion, with a solution of ten (10) ounces of polyvinyl acetate per gallon as a binder, and with 0.5 ounces per gallon of a methylated melamine resin as a cross-linking agent.

| Retention of Permethrin in Example III | |
|---|---|
| Example III-A | 37.0 percent after 5 Home Launderings. |
| Example III-B | 54.2 percent after 5 Home Launderings. |

Comment on Example III:

Use of a polyvinyl acetate binder and a cross-linking agent yields better laundering durability of permethrin than does use of a polyvinyl acetate binder alone.

The Second Embodiment—Surface Coating

Figure 2:
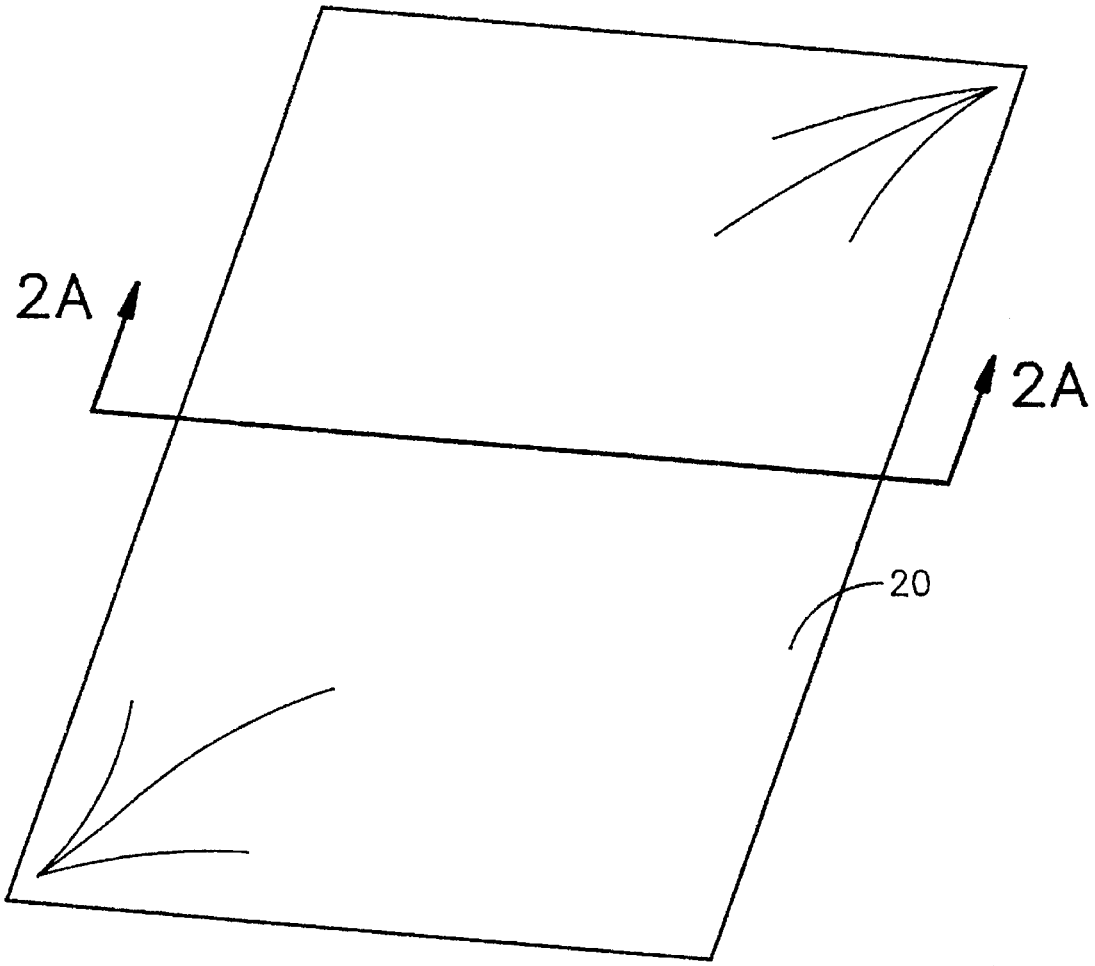
FIG. 2 is a perspective view of fabric that has been treated with permethrin by surface coating one side of the fabric with a dispersion of permethrin and a polymeric binder.
Figure 2A:
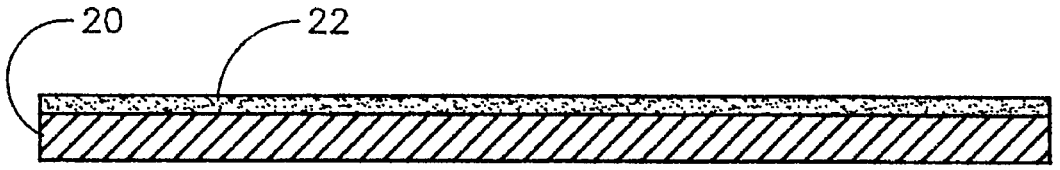
FIG. 2A is an enlarged sectional view taken substantially along the line 2A—2A in FIG. 2.

FIGS. 2 and 2A illustrate a fabric 20 that has been surface coated with a solution containing a dispersion of permethrin, a polymeric binder and a thickening agent. The permethrin, the polymeric binder and the thickening agent are indicated by the dots 22 in FIG. 2A. As seen in the sectional view of FIG. 2A, the dots 22 are spread throughout a layer on only one major surface of the fabric 20. There are no dots 22 in the body of the fabric 20. Similarly, there is no permethrin in the body of fabric that is surface coated with permethrin.

Fabrics have been surface coated on only one side with several solutions, each of which contain the same dispersion of permethrin, a thickener, and the indicated concentration of different polymeric binders and/or cross-linking agents. The treated fabrics were then subjected to home launderings and the percentage of permethrin remaining on the fabric was measured to compare the effectiveness of the binders in retaining permethrin on the fabric.

Examples of Surface Coating

Example IV

Example IV is a comparison of Example IV-A with Example IV-B to determine the retention of permethrin in fabric after five washings of the treated fabric.

Example IV-A Surface Coats the Fabric with Only Permethrin and a Thickening Agent.

Example IV-B Surface Coats the Fabric with Permethrin, a Thickening Agent and an Acrylic Binder.

In the fourth example, the fabric substrate is a 65/35 cotton/polyester blend.

In Example IV-A, the fabric was surface coated with only a permethrin dispersion and carboxymethylcellulose as a thickening agent.

In Example IV-B, the fabric was surface coated with a permethrin dispersion, with a 10% w/w solution of acrylic copolymer emulsion as a binder, and with carboxymethylcellulose as a thickening agent.

| Retention of Permethrin in Example IV | |
|---|---|
| Example IV-A | 25.2 percent after 1 Home Laundering. |
| Example IV-B | 42.9 percent after 1 Home Laundering. |

Comment on Example IV:

The addition of an acrylic binder to permethrin and a thickening agent yields better laundering durability than is obtained by merely adding a thickening agent to the permethrin.

Example V

Example V is a comparison of Example V-A with Example V-B to determine the retention of permethrin in fabric after five washings of the treated fabric.

Example V-A Surface Coats the Fabric with Permethrin, a Polyvinyl Acetate Binder, and a Thickening Agent.

Example V-B Surface Coats the Fabric with Permethrin, a Polyvinyl Acetate Binder, a Thickening Agent, and a Cross-Linking Agent.

In the fifth example, the fabric substrate is a 65/35 cotton/polyester blend.

In Example V-A, the fabric was surface coated with a permethrin dispersion, with a 10% w/w solution of polyvinyl acetate per gallon as a binder, and carboxymethylcellulose as a thickening agent.

In Example V-B, the fabric was surface coated with a permethrin dispersion, with a 10% w/w solution of polyvinyl acetate emulsion as a binder, with 0.5% w/w of methylated melamine resin as a cross-linking agent, and with carboxymethylcellulose as a thickening agent.

| Retention of Permethrin in Example V | |
|---|---|
| Example V-A | 63.3% after 5 Home Launderings; 59.0% after 10 Home Launderings. |
| Example V-B | 65.2% after 5 Home Launderings; 59.0% after 10 Home Launderings. |

Comment on Example V:

The addition of a cross-linking agent to a polyvinyl acetate binder in a thickened coating does not significantly increase the retention of permethrin in the fabric after repetitive laundering.

Example VI

Example VI is a comparison of Example VI-A with Example VI-B to determine the retention of permethrin in fabric after one home washing of the treated fabric.

Example VI-A Surface Coats the Fabric with Permethrin, a Polyvinyl Acetate Binder and a Thickening Agent.

Example VI-B Surface Coats the Fabric with Permethrin, an Acrylic Binder and a Thickening Agent.

In the sixth example, the fabric substrate is a 65/35 cotton/polyester blend.

In Example VI-A, the fabric was surface coated with a permethrin dispersion, with a 10% w/w solution of polyvinyl acetate emulsion as a binder, and carboxymethylcellulose as a thickening agent.

In Example VI-B, the fabric was surface coated with a permethrin dispersion, with a 10% w/w solution of acrylic copolymer emulsion as a binder, and carboxymethylcellulose as a thickening agent.

| Retention of Permethrin in Example VI | |
|---|---|
| Example VI-A | 42.7% after 1 Home Laundering. |
| Example VI-B | 42.9% after 1 Home Laundering. |

Comment on Example VI:

The addition of an acrylic binder to a thickened surface coating does not more significantly increase laundering durability than does the addition of a polyvinyl acetate binder.

Example VII

Example VII is a comparison of Example VII-A with Example VII-B to determine the retention of permethrin in fabric after five home washings of the fabric.

Example VII-A surface coats the fabric with Permethrin, a Polyvinyl Acetate Binder and a Thickening Agent.

Example VII-B Surface Coats the Fabric with Permethrin, a Polyvinyl Acetate Binder, a Thickening Agent, and a Cross-Linking Agent.

In the seventh example, the fabric substrate is a 65/35 cotton/polyester blend.

In Example VII-A, the fabric was surface coated with a permethrin dispersion, with a 10% w/w solution of polyvinyl acetate emulsion as a binder, and carboxymethylcellulose as a thickening agent.

In Example VII-B, the fabric was surface coated with a permethrin dispersion, with a 10% w/w solution of polyvinyl acetate emulsion as a binder, carboxymethylcellulose as a thickening agent, and 0.5% by volume of a methylated melamine resin as a cross-linking agent.

| Retention of Permethrin in Example VII | |
|---|---|
| Example VII-A | 52.7% after 5 Home Launderings. |
| Example VII-B | 47.8% after 5 Home Launderings. |

Comment on Example VII:

The use of a cross-linking agent with a polyvinyl acetate binder does not improve the laundering durability over the use of a polyvinyl acetate binder alone.

Example VIII

Example VIII is a comparison of three surface coatings: Example VIII-A, Example VIII-B, and Example VIII-C to determine the retention of permethrin in 100% cotton rip-stop fabric for battle dress uniforms after repetitive home launderings of the fabric.

Example VIII-A is a Thickened Coating of Only Permethrin.

Example VIII-B is a Thickened Coating of Permethrin with an Acrylic Binder.

Example VIII-C is a Thickened Coating of Permethrin with an Acrylic Binder, and a cross-linking agent.

In the eighth example, the fabric substrate is a 100% cotton Rip-Stop fabric intended for a military battle dress uniform.

In Example VIII-A, the fabric was surface coated with a permethrin dispersion, and carboxymethylcellulose as a thickening agent.

In Example VIII-B, the fabric was surface coated with a permethrin dispersion, with a 10% w/w solution of an acrylic copolymer emulsion as a binder, and carboxymethylcellulose as a thickening agent.

In Example VIII-C, the fabric was surface coated with a permethrin dispersion, with a 10% w/w solution of an acrylic copolymer emulsion as a binder, carboxymethylcellulose as a thickening agent, and 0.5% w/w of a methylated melamine resin as a cross-linking agent.

| Retention of Permethrin in Example VIII | | | |
|---|---|---|---|
| | After 1 Home Laundry | After 5 Home Laundries | After 10 Home Laundries |
| Example VIII-A | 59.5% | 30.2% | 4.76% |
| Example VIII-B | 86.4% | 46.2% | 18.2% |
| Example VIII-C | 74.8% | 39.9% | 23.8% |

Comment on Example VIII:

The use of an acrylic binder significantly improves the laundering durability of permethrin, and the addition of a cross-linking agent further improves the laundering durability of permethrin.

Example IX

Example IX is a comparison of three surface coatings: Example IX-A, Example IX-B, and Example IX-C to determine the retention of permethrin in 50/50 nylon/cotton fabric for battle dress uniforms after repetitive home launderings of the fabric.

Example IX-A is a Thickened Coating of Only Permethrin.

Example IX-B is a Thickened Coating of Permethrin with an Acrylic Binder.

Example IX-C is a Thickened Coating of Permethrin with an Acrylic Binder, and a cross-linking agent.

In the ninth example, the fabric substrate is a 50/50 nylon/cotton fabric intended for battle dress uniform, In Example IX-A, the fabric was surface coated with a permethrin dispersion, and carboxymethylcellulose as a thickening agent.

In Example IX-B, the fabric was surface coated with a permethrin dispersion, with a 10% w/w solution of an acrylic copolymer emulsion as a binder, and carboxymethylcellulose as a thickening agent.

In Example IX-C, the fabric was surface coated with a permethrin dispersion, with a 10% w/w of acrylic copolymer emulsion as a binder, carboxymethylcellulose as thickening agent, and 5% by volume of methylated melamine resin as a cross-linking agent.

| Retention of Permethrin in Example IX | | | |
|---|---|---|---|
| | After 1 Home Laundry | After 10 Home Laundries | After 20 Home Laundries |
| Example IX-A | 47.4% | Trace | None |
| Example IX-B | 77.7% | 29.9% | 5.98% |
| Example IX-C | 66.4% | 35.4% | 8.85% |

Comment on Example IX:

The use of an acrylic binder significantly improves the laundering durability of permethrin, and the addition of a cross-linking agent further improves the laundering durability of permethrin.

Example X

Example X is a comparison of Example X-A with Example X-B to determine the retention of permethrin in fabric after five washings of the treated fabric.

Example X-A Impregnates the Fabric with Only Permethrin.

Example X-B Surface Coats the Fabric with Only Permethrin and a Thickening Agent.

In the tenth example, the fabric substrate is a 65/35 cotton/polyester blend.

In Example X-A, the fabric was impregnated with only a permethrin dispersion.

In Example X-B, the fabric was surface coated with only a permethrin dispersion and carboxymethylcellulose as a thickener.

| Retention of Permethrin in Example X | |
|---|---|
| Example X-A | 30.8 percent after 5 Home Launderings. |
| Example X-B | 39.7 percent after 5 Home Launderings. |

Comment on Example X:

Surface coating the permethrin on one side of the fabric substrate with a thickening agent yields better laundering durability than impregnating the fabric with permethrin.

The Home Laundering Procedure

All of the home launderings in the foregoing examples were done in a KENMORE Ultra Fabric Care Heavy Duty 80 Series Residential Washing Machine. The sample was weighed and ballast fabrics were used to bring the load weight to four pounds. A 50 ml. beaker of ALL detergent was measured and added to the load. The washing machine was programmed for its normal cycle at its regular setting. The fabrics were washed in hot water (120° F.), with a cold rinse.

After each wash cycle, the load was dried with medium heat for 20 minutes in a HUEBSCH ORIGINATORS 30 Plus Commercial Dryer, and cooled for 5 minutes The Test Procedure The instrument and test procedure that were used for determining the quantity of permethrin remaining in the fabric after launderings is set forth below:

Gas Chromatography (GC):

Tre Metrics 541: Electron Capture Detector Column: 6-foot by ⅛ inch I.D. glass column packed with 3% OV-225 on 100/120 mesh Gas Chrom Q or equivalent. Gas: 5% Methane, 95% Argon

| | | |
|---|---|---|
| Condition: | Oven Temperature: | 245° C. |
| | Injector Temperature: | 225° C. |
| | Detector Temperature | 350° C. |
| | Injection Volume: | 2 ul |
| | Carrier gas flow rate: | 50 ml/minute |
| | Run Time: | Approximately 20 minutes per sample. |

Test Procedure:

Place each 12 square inches of the test specimen into a Soxhlet extraction thimble. This is prepared by cutting three layers of the test fabric with a 2"×2" die. Add 175 ml. of acetonitrile/methanol mixture and several boiling chips into a 250 ml. heat resistant flask. Assemble the Soxhlet extraction apparatus and extract the permethrin impregnated specimens for 6 hours. After extraction, the extract is to be diluted to 200 ml. total volume in a volumetric flask. Inject 1 ul of the extract into the GC.

Calculations:

A series of standard solutions of Permethrin are injected into the GC, integration of the two cis and trans peaks are recorded. A linear plot of the integrated are of both cis and trans peaks vs. concentration is created, and the equation of the line recorded. Using the equation of the line and the integrated area of an unknown's peaks, extrapolation to the unknowns concentration can be accomplished. This is to be reported in units of grams per square meter.

Note: If the linear plot's concentration axis is in units of grams per square meter, the extrapolation is expedited.

The Increased Efficacy of Surface Coating

Fabrics that are surface coated with permethrin have a greater insect repellent efficacy than fabrics that are impregnated with equal amounts of permethrin. One reason is apparent from a comparison of the physical location of permethrin in the fabric of FIG. 2A with the physical location of permethrin in the fabric of FIG. 1A.

In FIG. 2A all of the permethrin is located on only one major surface of the fabric. When that major surface becomes the outer surface of a garment, all of the permethrin is positioned to contact insects. At the same time it is positioned out of contact with the skin of the wearer.

In FIG. 1A the same quantity of permethrin is dispersed throughout the body of the fabric. Consequently, only the portion of the permethrin that is located on the surface of the fabric that becomes the outer surface of a garment is available for the repellency of insects. The rest of the permethrin is scattered throughout the fabric, as shown in FIG. 1A, with as much of the permethrin on the inside of a garment made from the fabric as there is on the outside.

Figure 3:
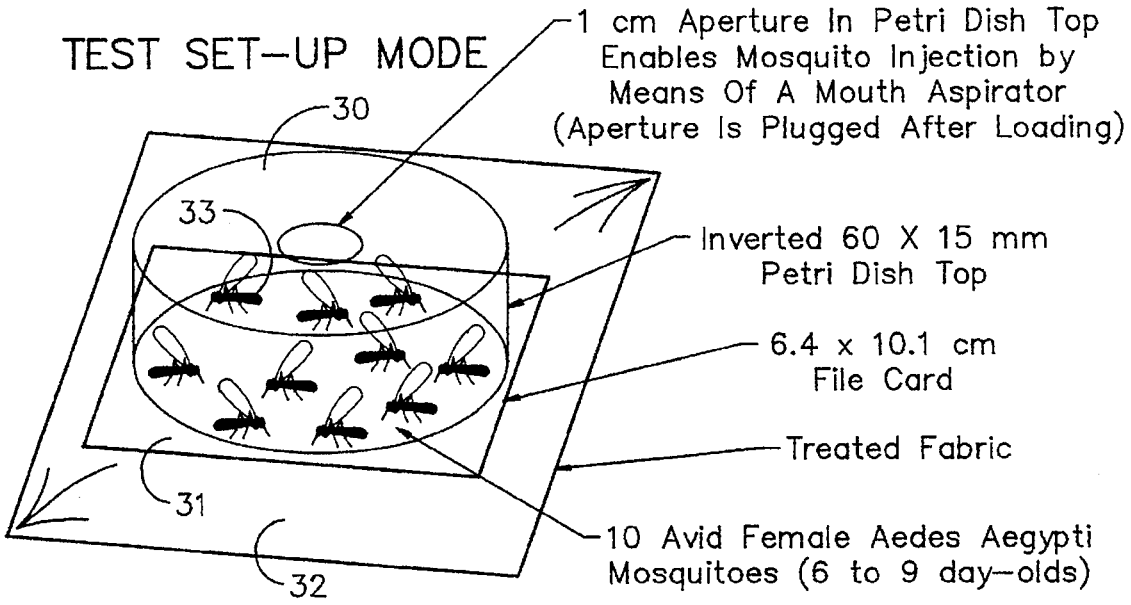
FIGS. 3 and 4 are perspective views illustrating the apparatus and the procedures used in determining the effectiveness of permethrin as an insect repellent.
Figure 4:
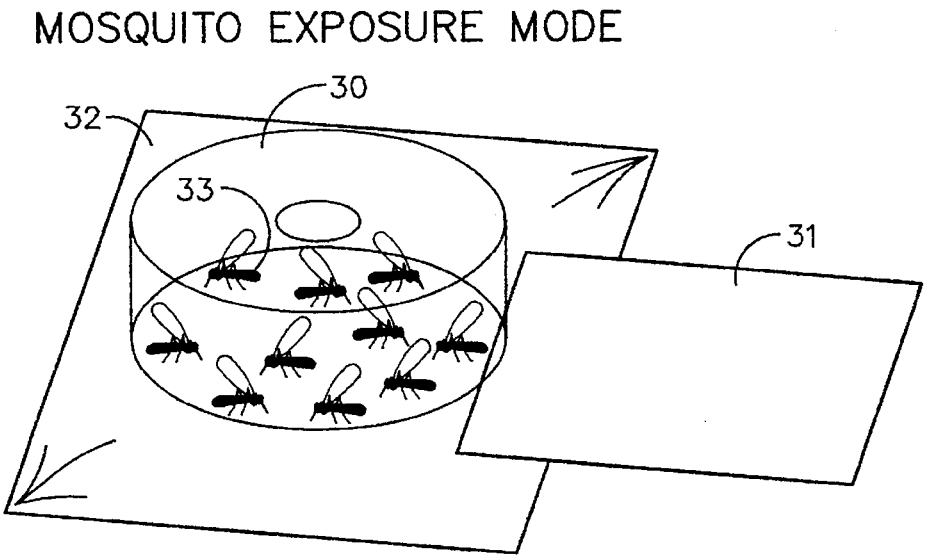

FIGS. 3 and 4 illustrate the apparatus and procedure used in an actual test that has confirmed the increased efficacy of surface coated permethrin in repelling insects. That test is the subject of Examples XI and XII.

As indicated in FIG. 3, the test was carried out by placing an inverted petri dish cover 30 on a card 31 that is positioned sequentially on differently treated pieces of fabric 32. One piece of fabric 32 was treated in accordance with Example XI, and another piece of fabric was treated in accordance with Example XII.

In each test, ten female *aedes aegypti* mosquitoes 33 were confined in the petri dish cover 30, as noted in FIG. 3, and the card 31 was gently slid from beneath the petri dish cover, allowing the mosquitoes to be in direct contact with the treated fabric 32. After the mosquitoes are exposed to the treated fabric 32 for an allotted time (5 to 60 minutes) the card 31 was gently returned to its initial position beneath the petri dish cover 30 to terminate the mosquitoes' exposure to the treated fabric. Knockdown counts are recorded 15 and 60 minutes after the mosquitoes are first exposed to the treated fabric by removal of the card 31.

Example XI

Impregnation

| | | |
|---|---|---|
| Formula | | |
| Water | 98% | |
| Permethrin | 2% | |
| Calculated concentration of permethrin | | 1.14 grams per square meter |
| Analyzed concentration of permethrin | | 1.17 grams per square meter |

The fabric face was exposed to insects in an enclosure for 5 minutes.

After 15 minutes, 25% of the *aedes aegypti* mosquitoes were knocked down.

After 60 minutes, 80% of the *aedes aegypti* mosquitoes were knocked down.

Example XII

Surface Coated

| | | |
|---|---|---|
| Formula | | |
| Water | 92.5% | |
| Permethrin | 5.5% | |
| Methocel | 2.0% (Thickener) | |
| Calculated concentration of permethrin | | 1.25 grams per square meter |
| Analyzed concentration of permethrin | | 0.85 grams per square meter |

-continued

| |
|---|
| The fabric face was exposed to insects in an enclosure for 5 minutes. After 15 minutes, 50.0% of the *aedes aegypti* mosquitoes were knocked down. After 60 minutes, 95.0% of the *aedes aegypti* mosquitoes were knocked down. |

It is apparent from this data that the surface treatment creates a more efficacious pest control fabric, which achieves quicker and greater knockdown than the impregnated fabric.

Another advantage of surface coating fabric intended for garments is that a surface coating on the outside of the garment minimizes skin contact to the wearer and maximizes the location of permethrin for contact by insects.

There is thus provided an improved method of increasing the durability of permethrin to repeated launderings of a treated fabric and an improved method of increasing the efficacy of an insecticide to repel insects. Although all of the examples herein have utilized permethrin as the insecticide, the described methods may be used with other insecticides within the spirit of the invention.

Although specific terms have been used in describing the invention, they have been used in a descriptive sense only, and not for the purpose of limitation.

We claim:

1. A method of enhancing the efficacy of fabric to repel insects before and after successive washings of the fabric, said method comprising the steps of:

(a) providing a solution containing a dispersion of an insecticide in a thickening agent; and (b) surface coating the solution on only one major surface of the fabric, the thickening agent functioning to dispose the insecticide essentially on but the one major surface of the fabric which was coated.

2. The invention of claim 1 wherein the insecticide is permethrin.

3. The invention of claim 1 wherein the solution includes a polymeric binder.

4. The invention of claim 2 wherein the solution includes a polymeric binder.

5. The invention of claim 2 wherein the thickening agent is carboxymethylcellulose.

6. The invention of claim 3 wherein the thickening agent is carboxymethylcellulose.

7. The invention of claim 1 wherein the thickening agent is carboxymethylcellulose.

8. The invention of claim 3 wherein the polymeric binder is acrylic copolymer.

9. The invention of claim 8 wherein the thickening agent is carboxymethylcellulose.

10. The invention of claim 9 wherein the solution includes a cross-linking agent.

11. The invention of claim 10 wherein the cross-linking agent is methylated melamine resin.

12. A method of treating fabric to repel insects, the fabric having an inner surface and an outer surface and being intended for the manufacture of washable garments, said method comprising the steps of:

(a) providing a solution containing a dispersion of an insecticide in a thickening agent and polyvinyl acetate; and (b) surface coating the solution on the outer surface of the fabric.

13. A method of treating fabric to repel insects, the fabric having an inner surface and an outer surface and being intended for the manufacture of washable garments, said method comprising the steps of:

(a) providing a solution containing a dispersion of permethrin in a thickening agent and polyvinyl acetate; and (b) surface coating the solution on the outer surface of the fabric.

14. A method of treating fabric to repel insects, the fabric having an inner surface and an outer surface and being intended for the manufacture of washable garments, said method comprising the steps of:

(a) providing a solution containing a dispersion of an insecticide in a thickening agent, a polymeric binder and a cross-linking agent; and (b) surface coating the solution on the outer surface of the fabric.

15. The invention of claim 14 wherein the cross-linking agent is methylated melamine resin.

16. A fabric intended to be used in the manufacture of washable garments, the fabric containing permethrin and means for retaining the permethrin in the fabric as an effective insecticide after the fabric has been made into garments and passed through successive wash cycles, said means comprising a polymeric binder of polyvinylacetate and a cross-linking agent.

17. The invention of claim 16 wherein the cross-linking agent is a methylated melamine resin.

18. A fabric having a coating disposed essentially on but one major surface thereof which functions as a means for repelling insects before and after successive washings of the coated fabric, said coating having been derived from a solution containing a dispersion of an insecticide in a thickening agent, the thickening agent having functioned to limit disposition of insecticide to said one major surface.

19. A fabric according to claim 18 wherein the insecticide is permethrin.

* * * * *